US005744735A

United States Patent [19]

Liao

[11] Patent Number: 5,744,735

[45] Date of Patent: Apr. 28, 1998

[54] FOLDING GUITAR STAND

[75] Inventor: Tsun-Chi Liao, Taichung, Taiwan

[73] Assignee: Hwa Shin Musical Instrument Co., Ltd., Taichung, Taiwan

[21] Appl. No.: 570,928

[22] Filed: Dec. 12, 1995

[51] Int. Cl.[6] ..... G10D 3/00

[52] U.S. Cl. ..... 84/327; 224/910; 248/443; 248/460

[58] Field of Search ..... 84/327; 224/910; 248/443, 460

[56] References Cited

U.S. PATENT DOCUMENTS 5,375,497 12/1994 Pirchio et al. ..... 84/327

*Primary Examiner*—Lincoln Donovan
*Assistant Examiner*—Shih-yung Hsieh
*Attorney, Agent, or Firm*—Bacon & Thomas

[57] ABSTRACT

A folding guitar stand includes a top member, two legs pivotably connected to a hollow bottom side of the top member, two connecting rods pivotably connected to the legs for supporting a guitar, and two foot members respectively fixed to the legs at the bottom, with each foot member having two balance rods being pivotable in opposite directions for supporting the stand on the ground.

4 Claims, 3 Drawing Sheets

FOLDING GUITAR STAND

BACKGROUND OF THE INVENTION

The present invention relates to guitar stands, and relates more particularly to a folding guitar stand which can be folded up when not in use.

A guitar is a musical instrument with six strings played with the fingers. When a guitar is not played, it must be properly supported in place or the sound box or strings will be damaged easily. U.S. Pat. No. 5,383,634, issued to the present inventor, shows a collapsible guitar stand for supporting a guitar. This collapsible guitar stand can be collapsed by turning the supporting rods upwards toward the front legs, moving the front legs inwards toward each other, and moving the back leg forward toward the front legs.

SUMMARY OF THE INVENTION

It is the principal object of the present invention to provide a folding guitar stand which can be conveniently extended out to support a guitar and, which can be conveniently folded up when not in use. According to the preferred embodiment of the present invention, the folding guitar stand comprises a top member, two legs pivotably connected to the hollow bottom side of the top member, two connecting rods pivotably connected to the legs for supporting a guitar, and two foot members respectively fixed to the legs at the bottom, each foot member having two balance rods pivotable in opposite directions for supporting the stand on the ground.

DETAILED DESCRIPTION OF THE PREFERRED EMBODIMENT

Figure 1:
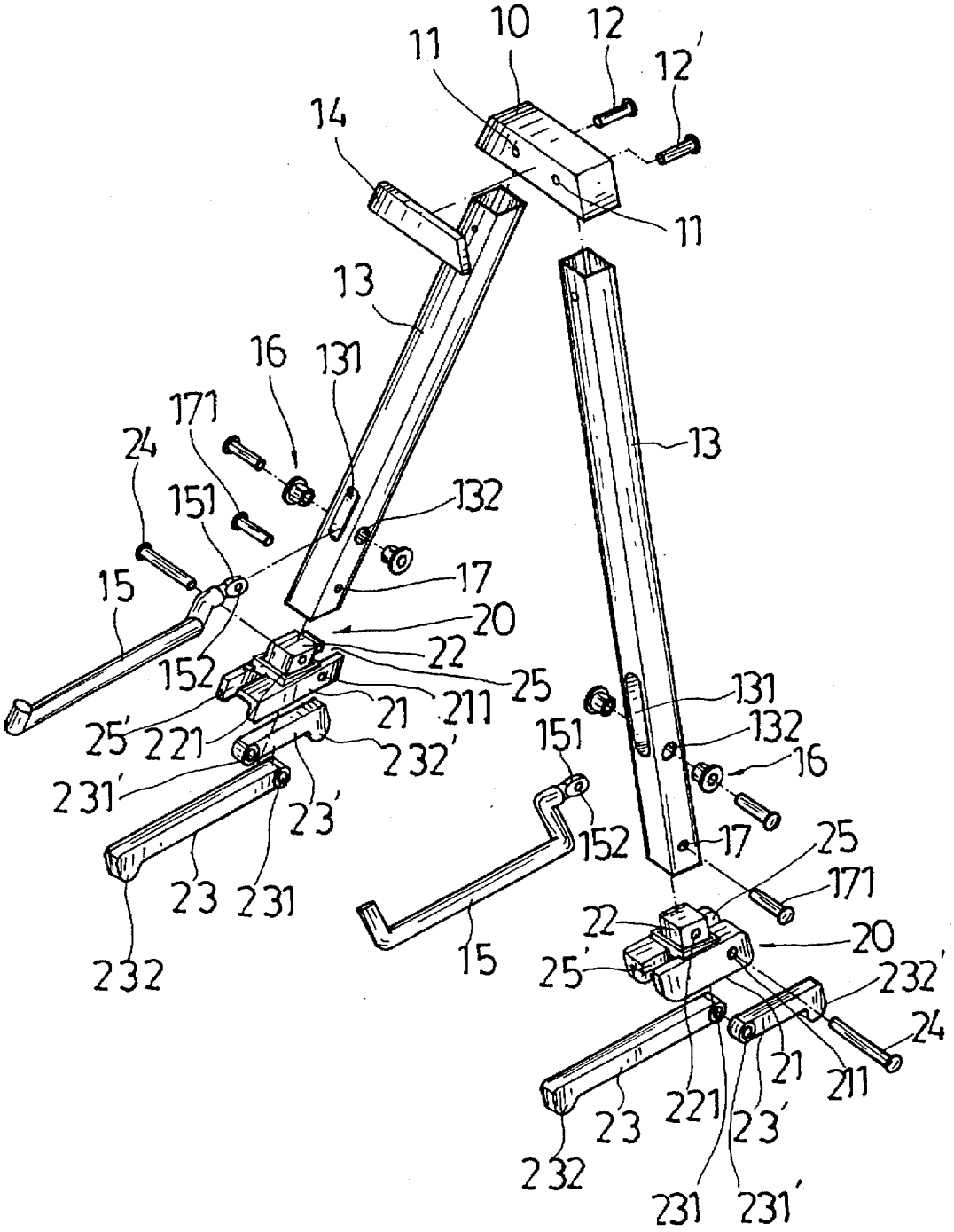
FIG. 1 is an exploded view of a folding guitar stand according to the present invention.
Figure 2:
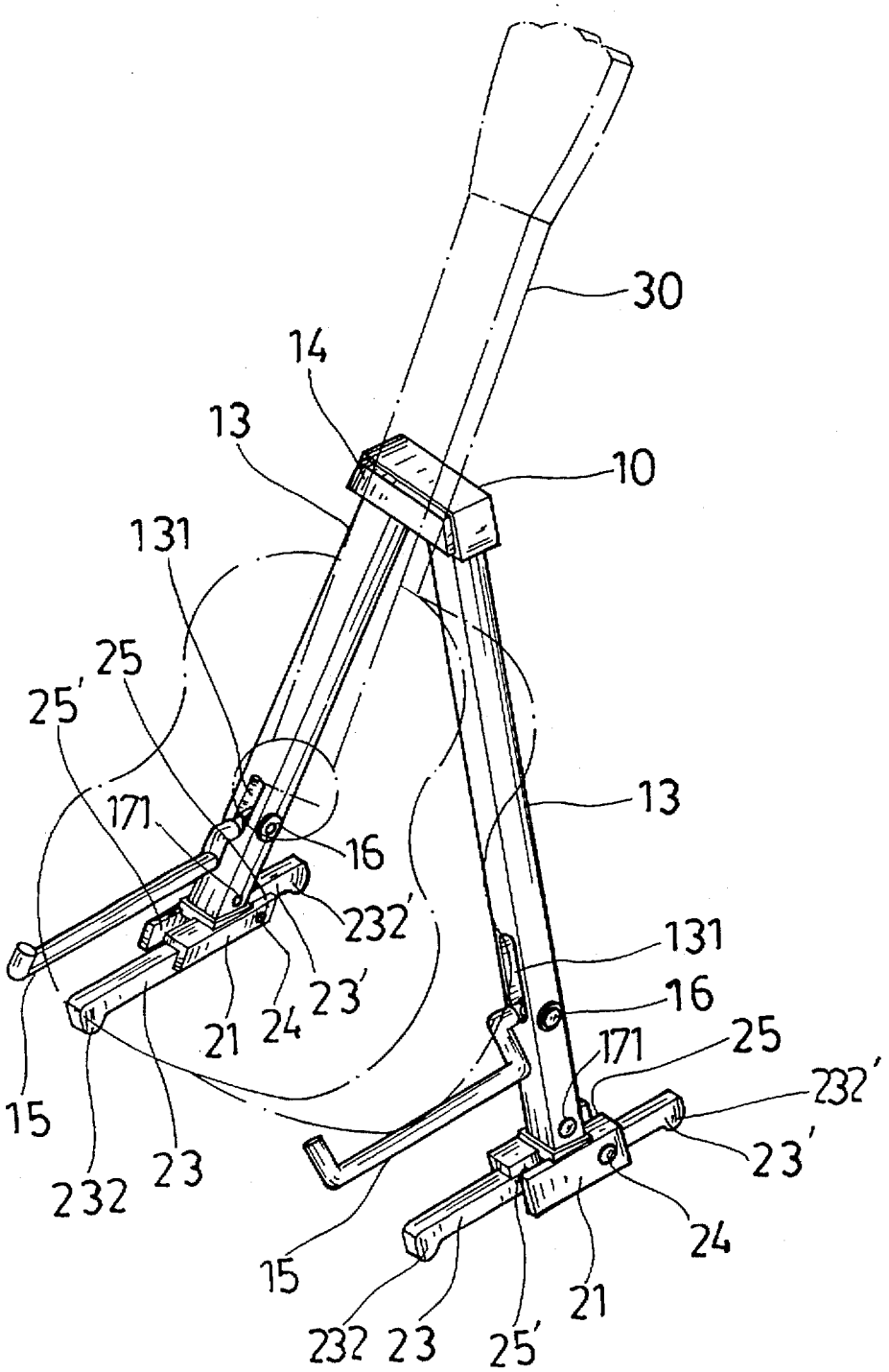
FIG. 2 shows the folding guitar stand extended according to the present invention.

Referring to FIGS. 1 and 2, the top member, referenced by 10, has two pivot holes 11. Two legs 13 are respectively pivotably connect to the pivot holes 11 by rivets 12 and 12'. The top member 10 is made of hollow structure which permits the legs 13 to be bilaterally turned outwards within a fixed range. An ornamental cover place 14 is fastened to the top member 10 for decoration, so that the headed ends of the rivets 12 and 12' will not be seen. The legs 13 are of hollow structure, each having an oblong hold 131 and a through hold 132 across the oblong hole 131 for mounting a respective supporting rod 15. The supporting rod 15 has a connecting plate 151 at one end and a pivot hole 152 at the connecting plate 151. When the connecting plate 151 of the supporting rod 15 is inserted into the oblong hold 131 on one leg 13, the pivot hold 152 of the connecting plate 151 is pivotable connected to the through hole 132 of the respective leg 13 by a fastening means 16. Each of the legs 13 further comprises a pivot hole 17 near the bottom end (remote from the top member 10) for mounting a respective foot member 20. The foot member 20 comprises a base 21, a coupling block 22 extending from the top of base 21 and fitted into the hollow bottom end of the leg 13, the coupling block 22 having a pivot hole 221 alignable with the pivot hole 17 of one leg 13 for connection thereto by a fastening element, for example, a rivet 171, a pivot hole 211 extending through base 21, and two balance rods 23 and 23' respectively pivotably connected to the pivot hole 211 of the base 21 by a pivot pin 24. Each balance rod 23 or 23' has a pivot hole 231 or 231' at one end for receiving and pivoting about the pivot pin 24, and a downwardly facing projecting portion 232 or 232' at an opposite end. Each base 21 is of hollow structure and defines a bottom chamber for receiving the balance rods 23 and 23' and permitting them to be pivoted about a fixed angle between an outward position of use and an inward position of storage. Furthermore, the bottom chamber of each base 21 includes two offset longitudinal slots 25 and 25' at two opposite ends for receiving the balance rods 23 and 23' when the balance rods 23 and 23' are pivoted inwardly in opposite directions into the position of storage.

Referring to FIG. 2, when in use, the legs 13 are extended out, the balance rods 23 and 23' are respectively pivoted out of each base 21 of the foot to support the foot members 20 into the outward position of use on the ground, and the supporting rods 15 are turned outwardly and downwardly from the legs 13 to the operative position substantially perpendicular to the legs 13 for supporting a guitar 30. Furthermore, the front balance rod 23 is relatively longer than the rear balance rod 23' so that the stand can be maintained stable when the guitar 30 is supported on the supporting rods 15.

Figure 3:
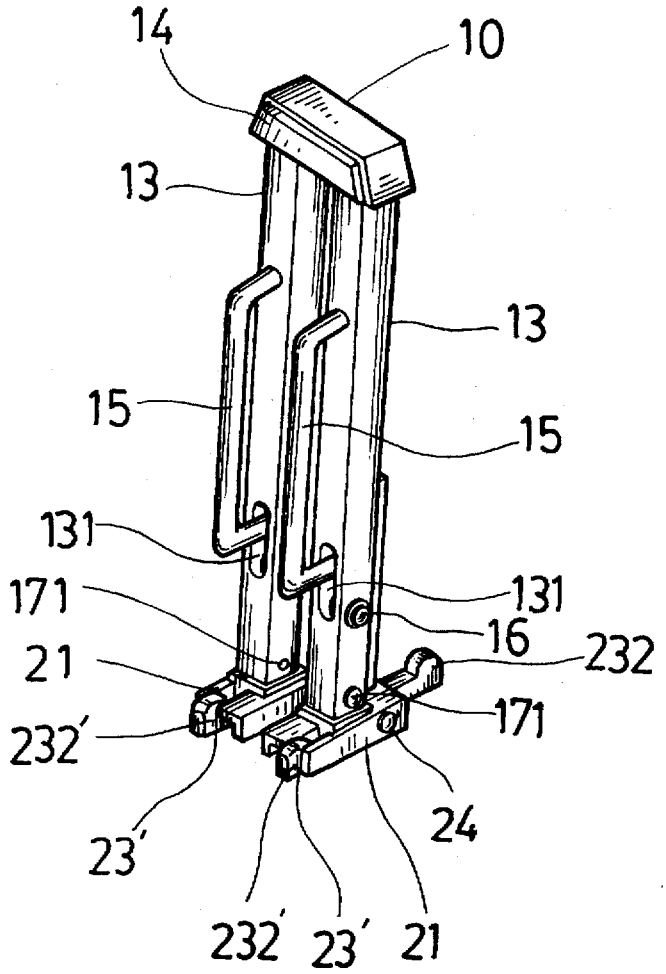
FIG. 3 shows the folding guitar stand folded up according to the present invention.

Referring to FIG. 3, when not in use, the balance rods 23 and 23' are respectively pivoted inwardly about pivot pin 24 in opposite directions, thus permitting the rods 23 and 23' to be received within the respective offset longitudinal slots 25 and 25', the supporting rods 15 are pivoted upwardly and inwardly for close attachment to the legs 13, and the legs 13 are pivoted inwardly toward each other into the position of storage.

I claim:

1. A folding guitar stand comprising a top member, two legs pivotally connected to said top member for pivotable movement between an extended position and a closed position, two supporting rods pivotally connected to said legs at a front side of each said leg and pivotable between an extended position perpendicular to said legs and a closed position in close attachment to said legs, a foot member fastened to each said leg at one and thereof remote from said top member, each said foot member including a base, a coupling block on the base, the block being fixedly secured to said leg, a pivot pin, a first balance rod and a second balance rod pivotally mounted to the base for pivotal movement about the pivot pin through a fixed angle in opposite directions between an outward position of use and an inward position of storage.

2. The folding guitar stand of claim 1 wherein said first balance rod is longer than said second balance rod and pivotable outwardly towards the front side of the leg.

3. The folding guitar stand of claim 1 wherein each of said first balance rod and said second balance rod has one end pivotably connected to the pivot pin of their respective base, and an opposite and terminating in a downwardly extending projecting portion for engaging the ground.

4. The folding guitar stand of claim 3 wherein the base of each foot member has two offset longitudinal slots at two opposite ends for receiving the respective balance rods in the inward position of storage.

* * * * *